US006807789B1

(12) United States Patent
Kim et al.

(10) Patent No.: US 6,807,789 B1
(45) Date of Patent: Oct. 26, 2004

(54) STEEL-CONCRETE COMPOSITE BEAM USING ASYMMETRIC SECTION STEEL BEAM

(75) Inventors: Dae-young Kim, Suwon (KR); Young-gyu Ju, Gwacheon (KR); Sung-chul Chun, Suwon (KR); Sang-dae Kim, Seoul (KR); Kwang-ryang Chung, Seoul (KR); Chan-hyoung Lee, Seoul (KR); Do-hyun Kim, Seoul (KR); Il-seob Moon, Seoul (KR)

(73) Assignees: Daewoo Engineering & Construction Co., LTD, Seoul (KR); Dongyang Structural Engineers Co., LTD, Seoul (KR); Haisung Engineering Co., Ltd., Seoul (KR)

( * ) Notice: Subject to any disclaimer, the term of this patent is extended or adjusted under 35 U.S.C. 154(b) by 0 days.

(21) Appl. No.: 10/444,597

(22) Filed: May 23, 2003

(51) Int. Cl.[7] ..... E04C 3/30
(52) U.S. Cl. ..... 52/729.1; 52/724.1
(58) Field of Search ..... 52/319, 326, 602, 52/432, 729.2, 724.1, 724.5, 729.1, 334, 252, 340

(56) References Cited

U.S. PATENT DOCUMENTS 1,086,343 A * 2/1914 Anderson ..... 249/25
1,654,013 A * 12/1927 Perrot ..... 52/264
1,794,425 A * 3/1931 Sorensen ..... 52/231
1,973,743 A * 9/1934 Billner ..... 52/340
2,028,169 A * 1/1936 Sahlberg ..... 52/334
3,093,932 A * 6/1963 Dreier et al. ..... 52/127.3
4,196,558 A * 4/1980 Jungbluth ..... 52/724.1
6,341,467 B1 1/2002 Wycech ..... 52/721.4

FOREIGN PATENT DOCUMENTS

KR 2002-0063451 8/2002
WO WO97/30240 8/1997

* cited by examiner

*Primary Examiner*—Milton Nelson, Jr.
(74) *Attorney, Agent, or Firm*—Ohlandt, Greeley, Ruggiero & Perle, L.L.P.

(57) ABSTRACT

Disclosed is a steel-concrete composite beam. The steel-concrete composite beam has an asymmetric I-section steel member having an upper flange, a lower flange and a web. The web is formed with at least one opening at a predetermined interval. The upper flange has a narrower width than the lower flange. A pair of C-section steel members is attached integrally to the lower flange of the asymmetric I-section steel form a first space filled with concrete. The concrete interlocks with the lower flange. A deck is supported on the C-section steel members. At least one transverse reinforcing bar of slab is arranged through the opening perpendicular to the asymmetric I-section steel. An upper concrete slab is poured with the concrete to be formed at a predetermined thickness. The concrete fills in a second space defined by the C-section steel members and the lower flange so that the upper flange of the asymmetric I-section steel is embedded.

4 Claims, 6 Drawing Sheets

(prior art)

STEEL-CONCRETE COMPOSITE BEAM USING ASYMMETRIC SECTION STEEL BEAM

BACKGROUND OF THE INVENTION

1. Field of the Invention

The present invention relates to a composite beam formed by a combination between a steel beam and concrete, and more particularly to a steel-concrete composite beam formed by a combination between an asymmetric I-section steel beam and reinforced concrete, in which the asymmetric I-section steel beam is designed so that an upper flange has a narrower than a lower flange.

2. Description of the Prior Art

Generally, a composite beam is integrally formed by a shear connection between a steel beam and a reinforced concrete slab. This composite beam has a bending stiffness about two to three times higher than that of the steel beam alone. Thus, the composite beam has a low deflection resulting from an imposed load, and is particularly advantageous to a beam, which is subjected to a vibration or an impact load.

Further, the composite beam can reduce a weight by 20 to 30% over the reinforced concrete beam, so that it is also advantageous to make a building lightweight. Owing to these advantages, the composite beam is broadly employed at present not only to civil structures such as a bridge and so on, but also to building structures.

However, unlike a civil structure, a building structure is designed to have its section in a way that a neutral axis of the composite beam is usually positioned adjacent to a boundary between a steel beam and a concrete slab. Thus, a compression side flange of the steel beam does not have a great influence on a bending strength. For this reason, the steel beam is manufactured so that its upper flange has a narrower width than that of its lower flange, so that the steel beam has an up-down asymmetrical section. This steel beam is called an "asymmetric section steel beam". In this manner, when the steel beam is manufactured to have the asymmetric section, the steel beam can be most effectively reduced in its section without having a great influence on its bending strength. Technique of constructing a floor slab structure using such an asymmetric section steel beam is disclosed in PCT/GB97/00239 (WO 97/30240), which is filed by Peter Wright et al.

Meanwhile, an asymmetric section steel composite beam combining the asymmetric section steel beam with the concrete slab is disclosed in Korean Patent Application Serial No. 2001-4121. Such an asymmetric section steel composite beam is shown in a sectional view in FIG. 1.

As shown in FIG. 1, the conventional asymmetric section steel composite beam includes an asymmetric I-section steel 1 in which an upper flange has a narrower width than an lower flange. Main reinforcing bars 2 are arranged longitudinal to the I-section steel, stirrups 3 enclose the main reinforcing bars. Lower precast concrete 4 is integrated with the lower flange of the I-section steel, and an upper concrete slab 5 integrated with the upper flange of the I-section steel.

This asymmetric section steel composite beam is constructed as follows. In FIG. 2, an asymmetric section steel composite beam prior to formation of the upper concrete slab is shown in a perspective view. First, a beam made up of the I-section steel 1, the main reinforcing bars 2, the stirrups 3 and the lower precast concrete 4 is manufactured at a factory, and then the beam is brought to the construction site and installed between columns or girders. To form the upper concrete slab 5, one end of a metal deck 6 is installed to span each edge of the lower precast concrete 4 as shown in FIG. 2. The upper concrete slab 5 is formed by pouring cast-in-place concrete on the supported metal deck 6 and so forth. As a result, the asymmetric section steel composite beam is completed. Alternatively, the typical form or a half slab may be used in place of the metal deck 6.

In this conventional asymmetric section steel composite beam, the I-section steel 1 is embedded in the upper concrete slab 5 at a predetermined depth. For this reason, when the transverse reinforcing bars of slab are arranged at the lower portion of the upper concrete slab 5, the transverse reinforcing bars of slab cannot be arranged continuously due to interruption caused by the I-section steel 1 embedded in the upper concrete slab 5. Thus, there is a disadvantage in that the transverse reinforcing bars of slab cannot be arranged continuously. Furthermore, this incurs another problem in that the upper concrete slab 5 is partially separated by the I-section steel 1, so that the conventional asymmetric section steel composite beam has weak structural uniformity.

Additionally, in the conventional asymmetric section steel composite beam, in order to unify the lower precast concrete 4 cast at a factory with the upper concrete slab 5 poured on site, the lower precast concrete 4 is provided with the stirrups 3 as shear connectors. In other words, the stirrups 3 are installed to bond between new concrete and old concrete. Installation of these stirrups 3 requires separate reinforcing bars, and thus a construction period becomes extended as well as construction costs become increased, which are considered as other problems.

Further, in order to perform a shear connection between the lower precast concrete 4 and the lower flange of the I-section steel 1, a plurality of studs 7 as shear connectors must be provided on the lower flange of the I-section steel 1.

SUMMARY OF THE INVENTION

Accordingly, the present invention has been made to solve the above-mentioned problems occurring in the prior art, and an object of the present invention is to provide a steel-concrete composite beam having an asymmetric I-section steel member. The beam has a pair of C-section steel members, thereby having an excellent structural uniformity, eliminating requirement to make use not only of the stirrups for combining the precast concrete with the upper concrete slab, but also of shear connectors such as the studs.

In order to accomplish this object, there is provided a steel-concrete composite beam. The steel-concrete composite beam has an asymmetric I-section steel member having an upper flange, a lower flange and a web. The web is formed with at least one opening at a predetermined interval. The upper flange has a narrower width than the lower flange. A pair of C-section steel members is attached integrally to the lower flange of the asymmetric I-section steel to form a first space. The first space is filled with concrete. The concrete is interlocked with the lower flange. A deck being supported on the C-section steel members and at least one transverse reinforcing bar of slab is arranged through the opening perpendicular to the asymmetric I-section steel member. An upper concrete slab is poured with the concrete to be formed at a predetermined thickness. The concrete is filled in a second space defined by the C-section steel members and the lower flange so that the upper flange of the asymmetric I-section steel is embedded therein.

The above and other objects, advantages and benefits of the present invention will be understood by reference to the detailed description provided below and the accompanying drawings.

DESCRIPTION OF THE DRAWINGS

The above and other objects, features and advantages of the present invention will be more apparent from the following detailed description taken in conjunction with the accompanying drawings, in which.

DETAILED DESCRIPTION OF THE INVENTION

Hereinafter, a preferred embodiment of the present invention will be described with reference to the accompanying drawings.

Figure 1:
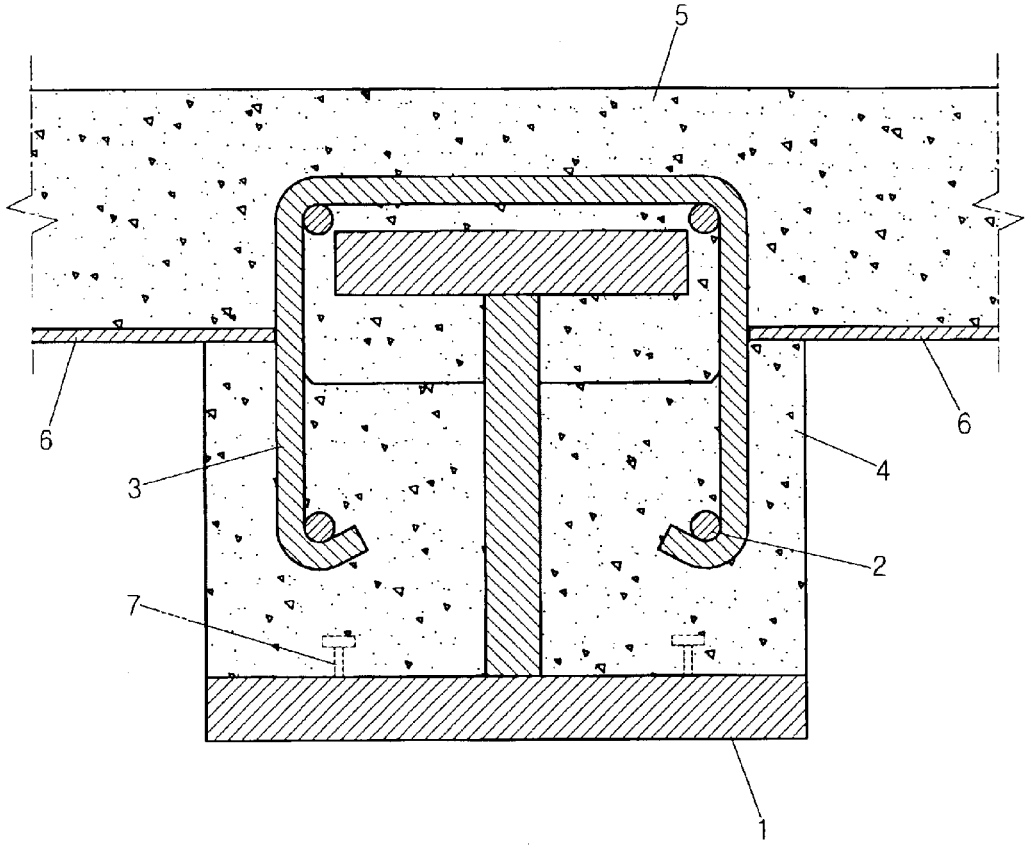
FIG. 1 is a sectional view of a conventional asymmetric section steel composite beam.
Figure 2:
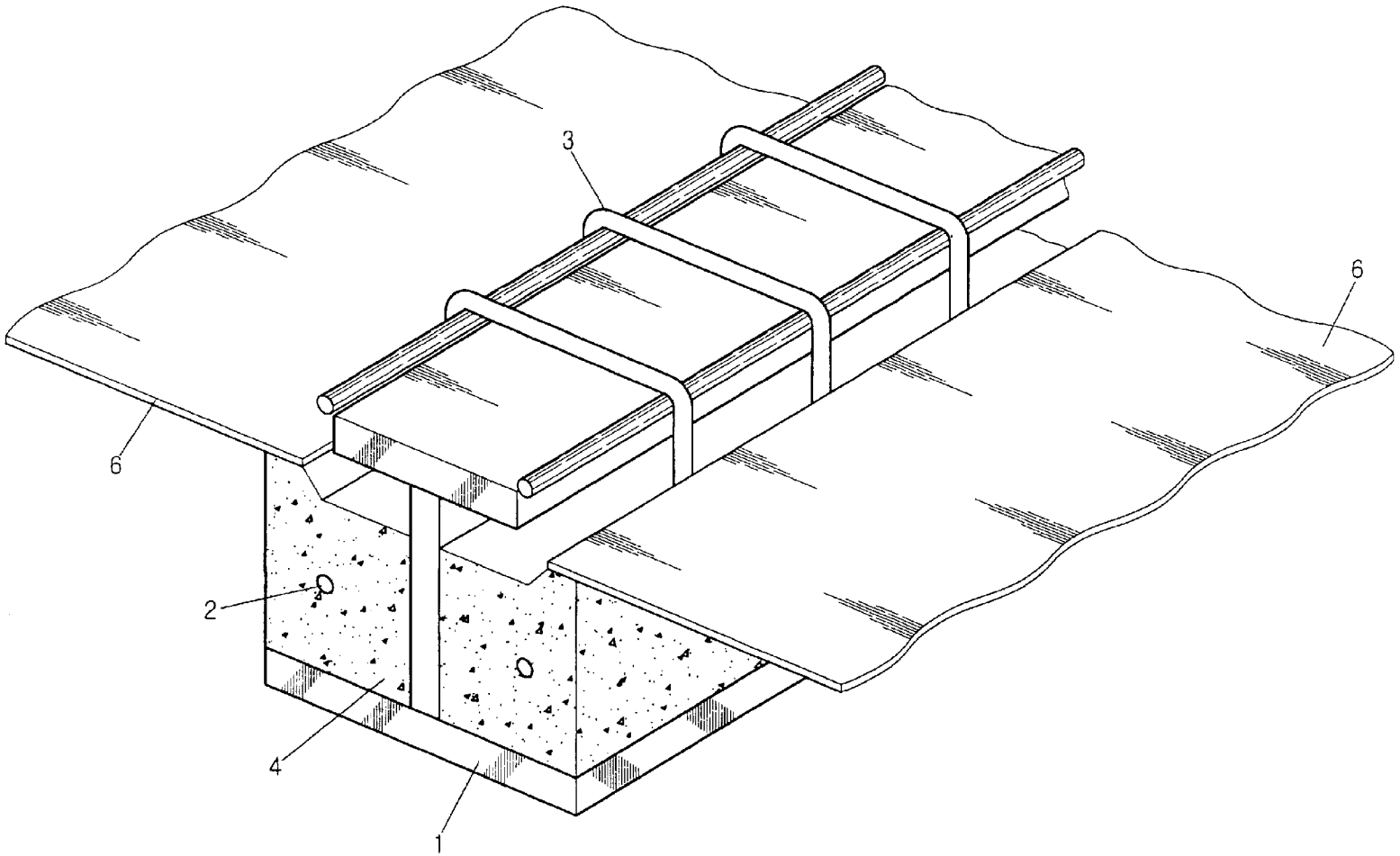
FIG. 2 is a schematic perspective view illustrating a conventional asymmetric section steel composite beam prior to formation of an upper concrete slab.
Figure 3:
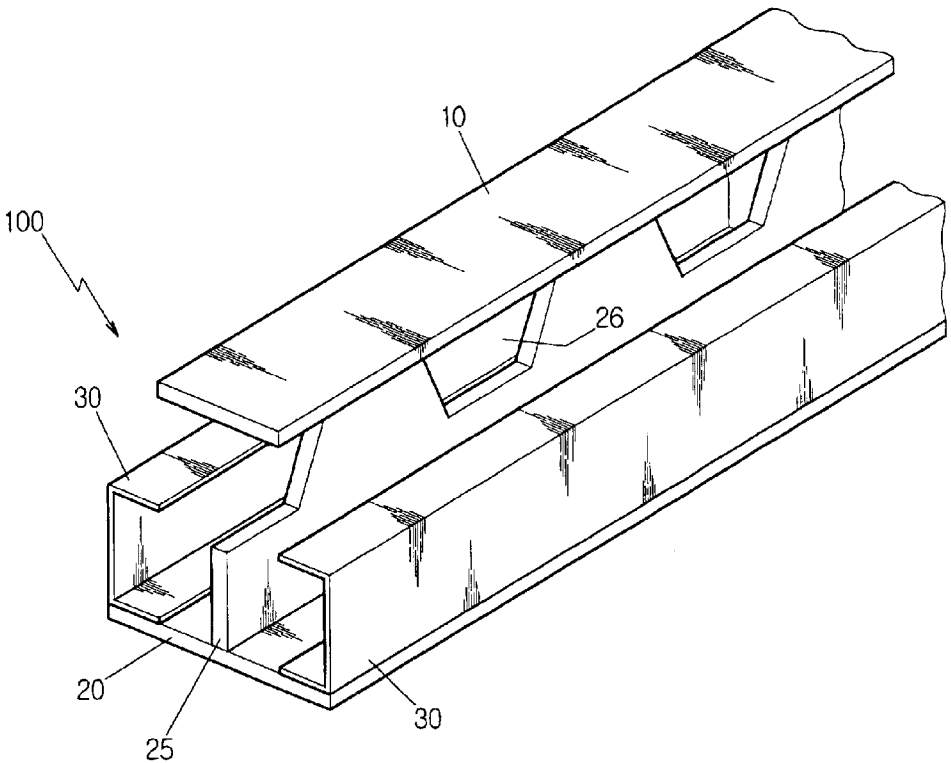
FIG. 3 is a perspective view of an asymmetric section steel beam employed to a steel-concrete composite beam according to the present invention.
Figure 4:
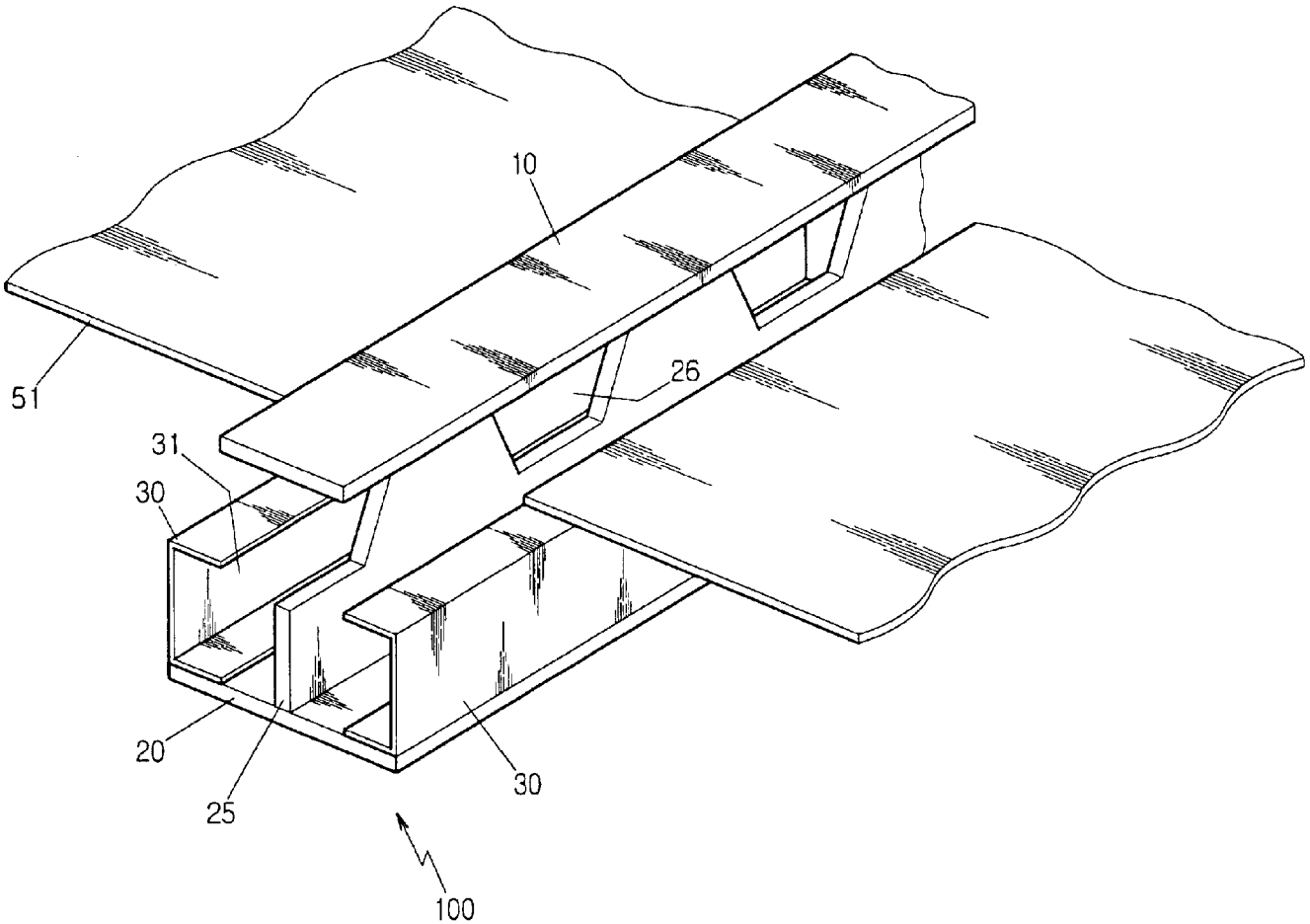
FIG. 4 is a perspective view of an asymmetric section steel beam with a metal deck prior to formation of an upper concrete slab.

FIG. 3 is a perspective view of an asymmetric section steel beam employed to a steel-concrete composite beam according to the invention. FIG. 4 is a perspective view of an asymmetric section steel beam with a metal deck prior to formation of an upper concrete slab.

As shown in FIG. 3, the asymmetric section steel beam 100, which is employed to the steel-concrete composite beam of the invention, includes an asymmetric I-section steel having an upper flange 10, a web 25 and a lower flange 20, and a pair of C-section steel members 30. The C-section steel members are attached to the lower flange 20 of the asymmetric I-section steel beam 100. Herein, the asymmetric I-section steel beam 100 refers to one having an asymmetric section in which the upper flange 10 has a narrower width than the lower flange 20. The web 25 is formed with at least one opening 26 at a predetermined interval.

In the embodiment shown in FIG. 3, the opening 26 with which the asymmetric section steel beam 100 is provided has a trapezoidal shape. However, one skilled in the art should appreciate that the opening 26 has no restriction on such a shape.

The C-section steel members 30 are attached on the opposite edges of the lower flange 20 of the asymmetric I-section steel beam 100 with each other in facing relationship. The C-section steel members 30, each of which is formed by folding a steel plate, function as a form while concrete is poured toward the sides of the web 25 of the asymmetric I-section steel. Further, when a metal deck 51 is installed so as to form an upper concrete slab 50, the C-section steel members 30 function as a support stand which is spanned with the metal deck 51.

The asymmetric section steel beam 100 manufactured in this manner is brought to the construction site and installed between columns, between a column and a girder or between girders. As shown in FIG. 4, one edge of the metal deck 51 is supported on the top surfaces of each of the C-section steel members 30. One or more transverse reinforcing bars of slab 27 are arranged through each opening 26 of the web 25. Subsequently, concrete is poured on the metal deck 51. The poured concrete enters into a gap between the upper flange 10 and the C-section steel members 30, and fills a space 31 being defined by the C-section steel members 30.

Figure 5:
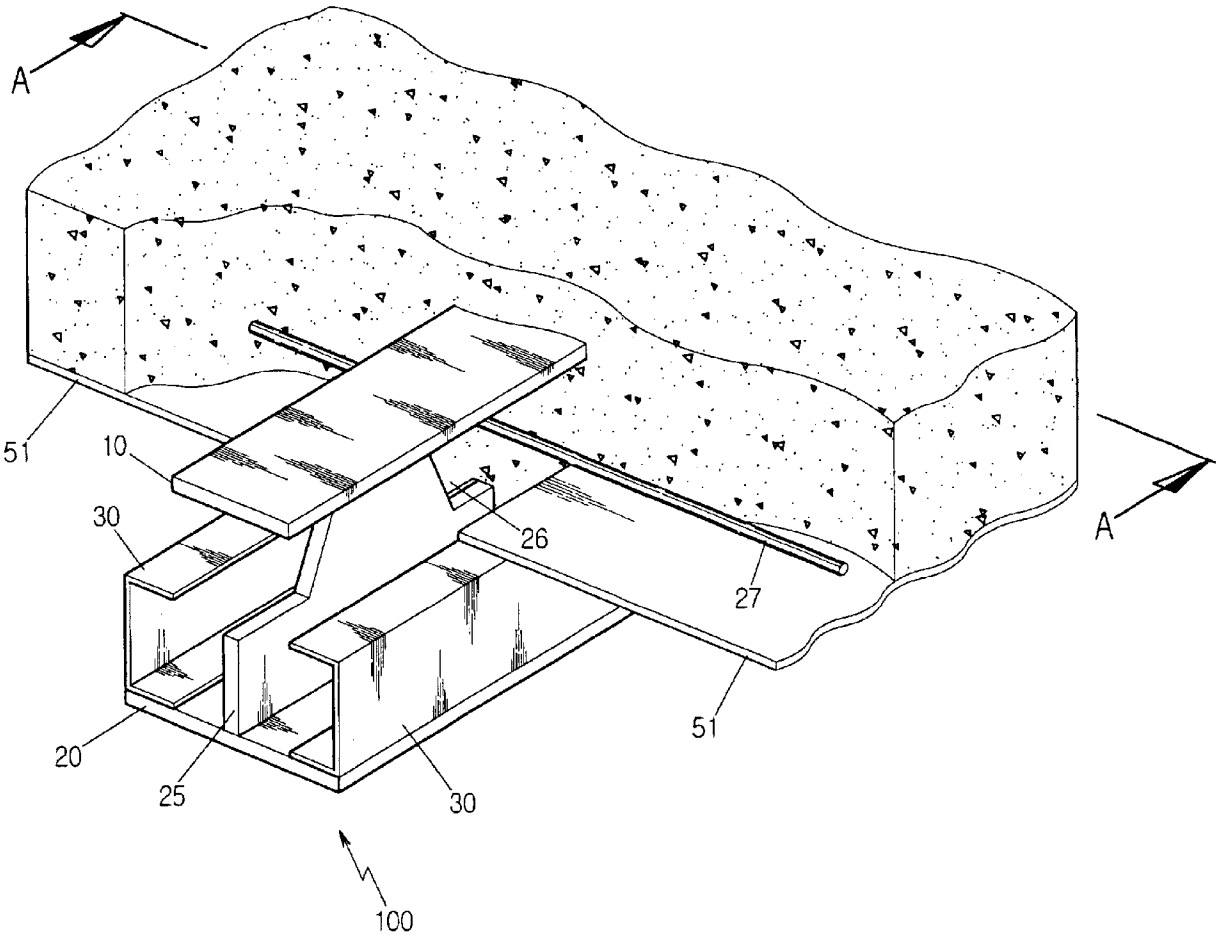
FIG. 5 is a partial broken perspective view of an asymmetric section steel beam completed with an upper concrete slab in accordance to the invention.
Figure 6:
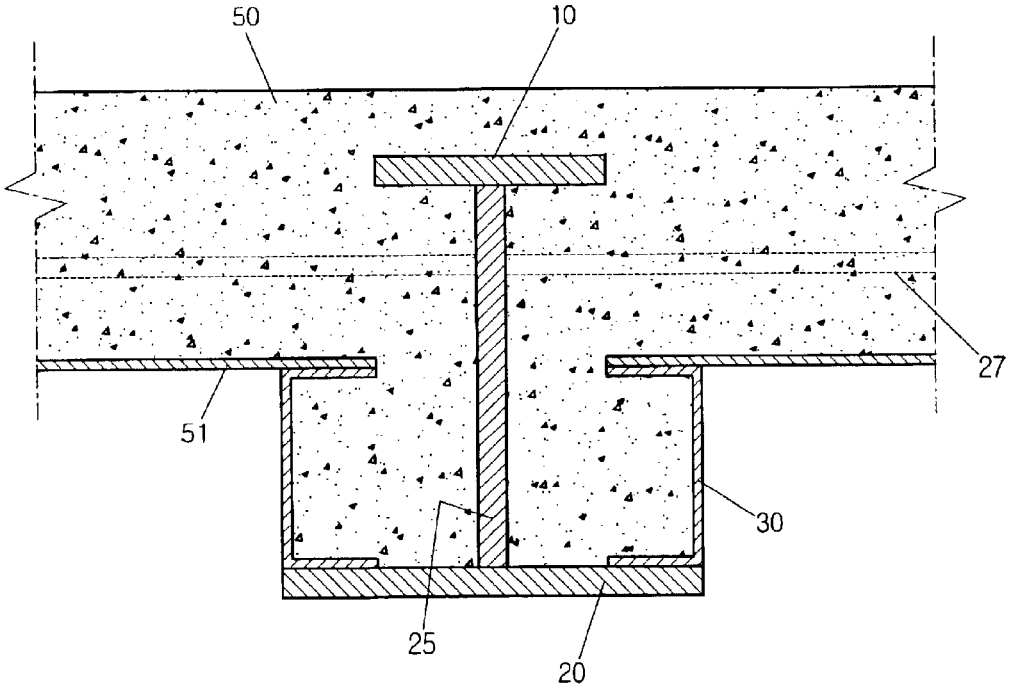
FIG. 6 is a cross-sectional view taken along the line A—A of FIG. 5.

FIG. 5 is a partial broken perspective view of an asymmetric section steel beam completed with an upper concrete slab in accordance to the invention. In FIG. 5, the upper concrete slab 50 is partially removed in order to show one transverse reinforcing bar of slab 27. FIG. 6 is a cross-sectional view taken along the line A—A of FIG. 5, in which concrete is filled into a second space between C-section steel members 30.

As shown in FIGS. 5 and 6, the concrete is poured on the metal deck 51, and is filled into the gap between the web 25 and the opposite C-section steel members 30. Then, the space defined by the C-section steel members 30 is filled with concrete, and the upper concrete slab 50 is formed on the metal deck 50 at a predetermined thickness, so that the steel-concrete composite beam according to the present invention is completed.

This asymmetric section steel-concrete composite beam according to the present invention has an excellent structural uniformity unlike the conventional steel-concrete composite beam, because the concrete interlocked with the lower flange of the I-section steel is integrally formed with the concrete made up of the upper concrete slab 50.

Further, according to the present invention, concrete on both sides of the I-section steel are united with each other through the openings 26 of the web 25. The transverse reinforcing bars of slab 27 are arranged through the openings 26, so that an intensity of a horizontal shear force is increased between the I-section steel and the upper concrete slab 50. Therefore, to combine the precast concrete, which is interlocked with the I-section steel, with the upper concrete slab, that is, to combine the new concrete with the old concrete, the conventional composite beam required stirrups, but the present invention does not require such stirrups.

In addition, in the present invention, concrete on both sides of the I-section steel are united with each other through the openings 26 of the web 25, and the transverse reinforcing bars of slab 27 are arranged through the openings 26. In this manner a strong connection relative to the prior art is provided between the concrete formed on the lower flange 20 and the lower flange 20. Thus, no shear connectors such as the studs are required.

Meanwhile, to form the upper concrete slab 50, a half slab, a deck plate or a typical form may be used in place of the metal deck 51. In the present invention, one or more edges of the metal deck 51 are supported by the C-section steel members 30. In this manner it is easy to support an imposed load when a prefabricated slab construction system is applied. Therefore, when a prefabricated slab construction system is applied, a non-shored construction method can be used.

Further, in the present invention, the concrete interlocked with the lower flange 20 has an outer side protected by each of the C-section steel members 30, and thus the surface of the concrete is prevented from be deteriorated. Moreover, the concrete encloses the web of the I-section steel, the steel beam has an improved durability.

As mentioned above, the steel-concrete composite beam according to the present invention has an excellent structural uniformity, because the concrete interlocked with the lower flange of the I-section steel is integrally formed with the concrete made up of the upper concrete slab 50.

Further, in the present invention, concrete on both sides of the I-section steel are integrally formed with each other through the openings 26 of the web 25, and the transverse reinforcing bars of slab 27 are arranged through the openings 26. As a result, a horizontal shear force between the I-section steel and the upper concrete slab 50 has an increased intensity. Therefore, it is unnecessary to make use of the stirrups for combining the precast concrete with the upper concrete slab. Also, a strong connection is provided between the concrete formed on the lower flange 20 and the lower flange 20, so that shear connectors such as the studs are not required.

It should be understood that the foregoing description is only illustrative of the present invention. Various alternatives and modifications can be devised by those skilled in the art without departing from the invention. Accordingly, the present invention is intended to embrace all such alternatives, modifications and variances.

What is claimed is:

1. A composite beam comprising:

a beam having a first flange having a first width;

a second flange having a second width;

an intermediate member being formed with an aperture, wherein said first flange is connected to said second flange by said intermediate member, said first width being less than said second width; and a first member and a second member being connected to said second flange, said first member and said second member forming a space therebetween, wherein said space is filled with concrete, said concrete flowing through said aperture.

2. The composite beam of claim 1, further comprising at least one transverse reinforcing bar being disposed through said aperture.

3. The composite beam of claim 2, further comprising a second concrete slab being formed with said concrete at a predetermined thickness, wherein the first flange is embedded in said second concrete slab.

4. A steel-concrete composite beam comprising:

an asymmetric I-section steel member having an upper flange, a lower flange and a web, the web being formed with at least one opening at a predetermined interval, the upper flange having a narrower width than the lower flange;

a pair of C-section steel members being connected integrally to the lower flange of the asymmetric I-section steel member to form a space being filled with concrete, the concrete being interlocked with the lower flange;

a deck being supported on the C-section steel members;

at least one transverse reinforcing bar of slab arranged through the opening perpendicular to the asymmetric I-section steel member; and an upper concrete slab being formed with the concrete at a predetermined thickness, wherein the upper flange of the asymmetric I-section steel member is embedded in the upper concrete slab.

* * * * *